US006175338B1

(12) United States Patent
Quade

(10) Patent No.: US 6,175,338 B1
(45) Date of Patent: Jan. 16, 2001

(54) DIPOLE FEED ARRANGEMENT FOR REFLECTOR ANTENNA

(75) Inventor: Hans-Peter Quade, Kilsyth (AU)

(73) Assignee: Alcatel, Paris (FR)

( * ) Notice: Under 35 U.S.C. 154(b), the term of this patent shall be extended for 0 days.

(21) Appl. No.: 09/324,854

(22) Filed: Jun. 3, 1999

(30) Foreign Application Priority Data

Aug. 27, 1998 (AU) ..... PP5495

(51) Int. Cl.[7] ..... H01Q 1/38; H01Q 19/13
(52) U.S. Cl. ..... 343/795; 343/840
(58) Field of Search ..... 343/795, 840; H01Q 1/36, 1/38, 19/13, 9/28

(56) References Cited

U.S. PATENT DOCUMENTS 5,229,782 * 7/1993 Hemmie et al. ..... 343/795

* cited by examiner

*Primary Examiner*—Michael C. Wimer
(74) *Attorney, Agent, or Firm*—Sughrue, Mion, Zinn, Macpeak & Seas, PLLC

(57) ABSTRACT

A dipole feed arrangement for a parabolic reflector antenna, comprises a printed circuit board (PCB) having on one side a conductive pattern in the form of two spaced dipoles each bifurcated by a respective slot, and whose centre parts are connected by a conductor element, one half of the conductor element being provided with two spaced notches. A coaxial feeder cable's outer conductor is connected to a connection zone in the conductor element, and its inner conductor passes through a hole and connected to a transmission line element on the opposite side of the PCB. Plated through holes connect the transmission line element to the dipoles. The arrangement allows substantially identical current amplitudes to flow into each half of each dipole, thereby providing a desirable optimum symmetry of the feed arrangement's radiation pattern.

8 Claims, 2 Drawing Sheets

DIPOLE FEED ARRANGEMENT FOR REFLECTOR ANTENNA

BACKGROUND OF THE INVENTION

This invention relates to antennas of the type having a parabolic reflector element for concentrating microwave radiation, transmitted from a feed arrangement located at the focal point of the reflector, into a collimated microwave beam. More particularly, the invention relates to feed arrangements for such antennas.

Parabolic reflector antennas are used for directional radio and satellite transmission. The parabolic reflector can be a grid structure or a solid structure.

The reflectors of the antennas are normally illuminated by feed arrangements in the form of either a buttonhook feed horn or a dipole radiator with a subreflector. Horn fed antennas are normally used for frequencies above 3 GHz, and dipole radiator arrangements are used for frequencies below 3 GHz.

Above 3 GHz, required dimensions of the horn feed structure of a horn fed antenna are such that the minimum parabolic reflector size is typically limited to about 1.8 meters. Below this reflector size the antenna suffers aperture blockage which degrades the radiation pattern of the antenna and renders it less efficient.

Known dipole feed arrangements are commonly made from discrete machined metallic components, and moreover, require a separate balun arrangement.

SUMMARY OF THE INVENTION

It is an object of the present invention to provide a cost effective, easily manufactured dipole feed arrangement for a reflector antenna for operation at frequencies above 3 GHz.

It is a further object of the present invention to provide a dipole feed arrangement for a reflector antenna, that has an integral balun.

It is a still further object of the present invention to provide a dipole feed arrangement for a reflector antenna, that can be implemented using printed circuit board (PCB) techniques.

According to the invention there is provided a dipole feed arrangement for a parabolic reflector antenna, said arrangement comprising a planar member of insulating material supporting on one side thereof a first pattern of conductive material forming at least two spaced parallel dipole elements of pre-determined dimensions whose respective intermediate parts are connected by a single conductive element provided with two opposite collinear slots whose electrical lengths are approximately one quarter of a wavelength at said antenna's operating frequency, said slots bifurcating respective dipoles, said conductive element including a first connection zone for connection of a coaxial feeder cable's outer conductor, said slots and said conductive element forming part of an integral balun means, wherein said conductive element further includes at least two spaced notches of predetermined depth and location on one side of the said conductor element, and wherein a second pattern of conductive material is supported on the other side of said planar member, forming a transmission line element provided with a second connection zone for connection to said coaxial feeder cable's inner conductor, said first connection zone and said second connection zone being coaxial, said transmission line element having two spaced through-connection means each of which communicates with a pre-determined part of a respective dipole element.

BRIEF DESCRIPTION OF THE DRAWINGS

In order that the invention may be readily carried into effect, an embodiment thereof will now be described in relation to the accompanying drawings, in which.

DETAILED DESCRIPTION OF THE INVENTION

Figure 1:
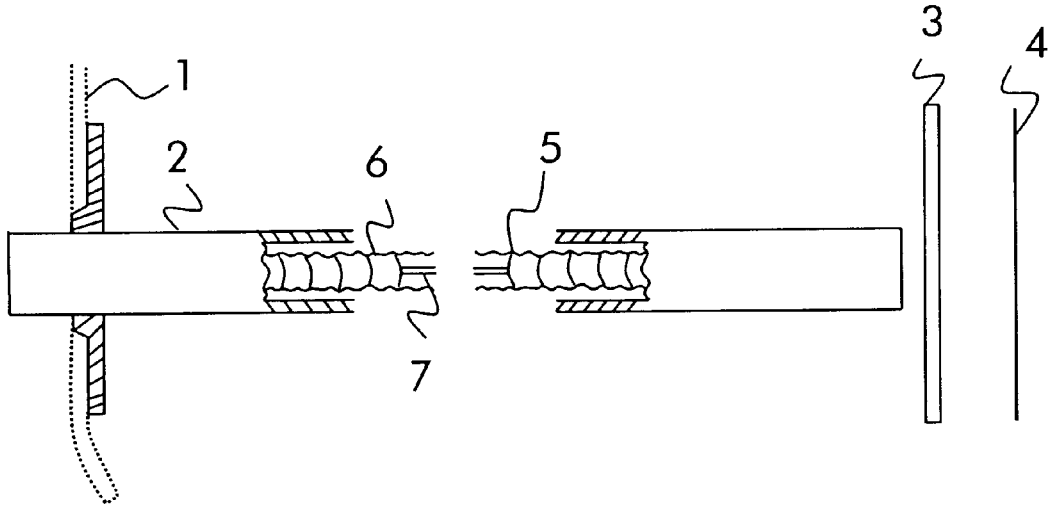
FIG. 1 is a side view in elevation, partially broken away in section, of a reflector antenna assembly, whose parabolic reflector is fragmentarily illustrated, incorporating the dipole feed arrangement of the present invention.

Referring to FIG. 1, the parabolic reflector antenna comprises a parabolic reflector 1 (fragmentarily illustrated), a feed tube 2 centrally mounted on the reflector 1, a dipole feed arrangement 3, in the form of a printed circuit board, located at the focal point of the parabolic reflector, and a solid metal sub-reflector 4, located approximately one quarter wavelength rearwardly of the dipole feed arrangement. Both the dipole arrangement 3 and the sub-reflector 4 are fixedly mounted by mounting means within an enclosing radome (not shown) attached to feed tube 2.

A coaxial feeder cable 5, having an outer conductor 6 and an inner conductor 7 is located within the feed tube 2, and extends from the dipole feed arrangement to a terminal means, not shown, at rear of the reflector 1.

Figure 3:
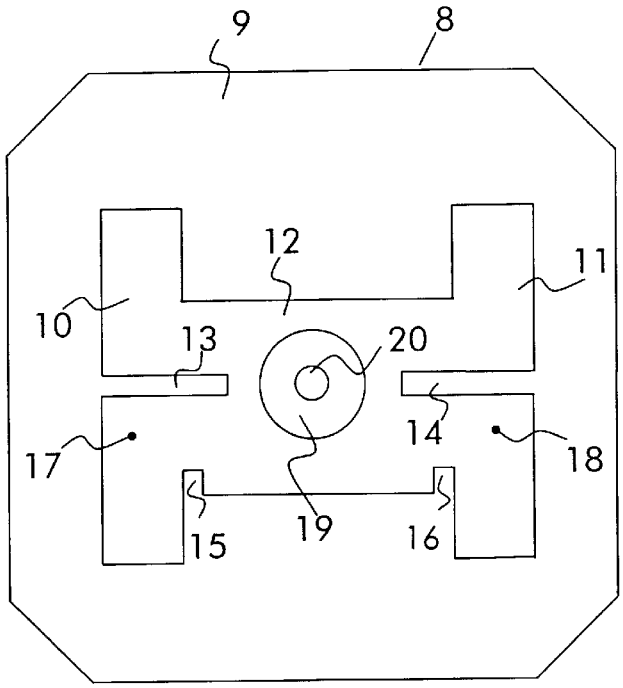
FIG. 3 shows a view in front elevation of the dipole feed arrangement of the present invention.
Figure 4:
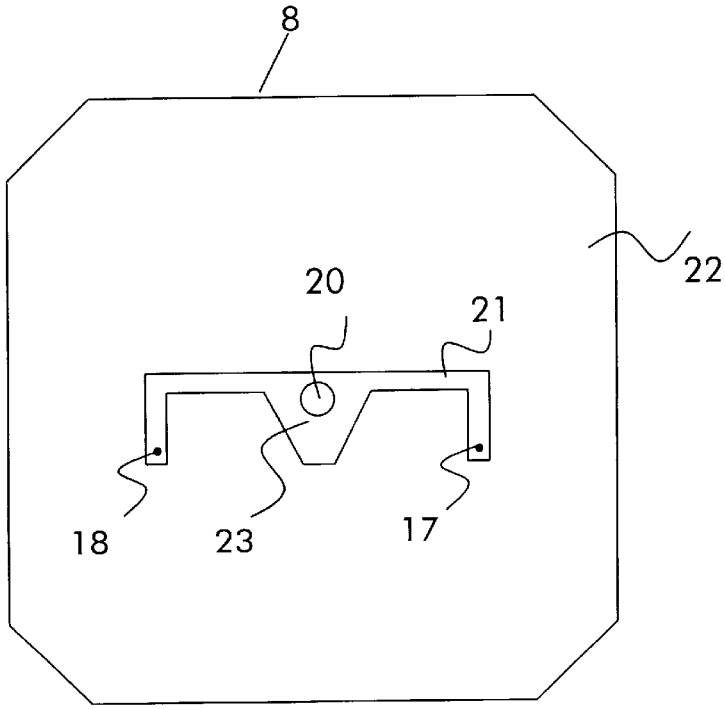
FIG. 4 shows a view in rear elevation of the dipole feed arrangement shown in FIG. 3.

Referring now to FIGS. 3 and 4, the characteristic dipole feed arrangement 3 comprises an 8.0 cm×8.0 cm octagonal shaped planar support 8 of insulating material, on one surface 9 (FIG. 3) of which is supported a conductive pattern comprising two parallel dipole elements 10 and 11, each being 3.5 cm in length. The intermediate part of one dipole is connected to the intermediate part of the other dipole by a common conductor element 12.

The conductor element includes two 13 mm×1 mm collinear slots 13 and 14, each bifurcating an associated dipole. Each slot is approximately one quarter of an electrical wavelength at the operating frequency of the antenna (e.g. 3.5 GHz). On one side of the conductor element 12, two spaced notches 15 and 16 are provided.

The dipoles 10 and 11 are each provided with a through—connection 17, 18 which communicate with the opposite surface of planar support 8 (see FIG. 4).

Figure 2:
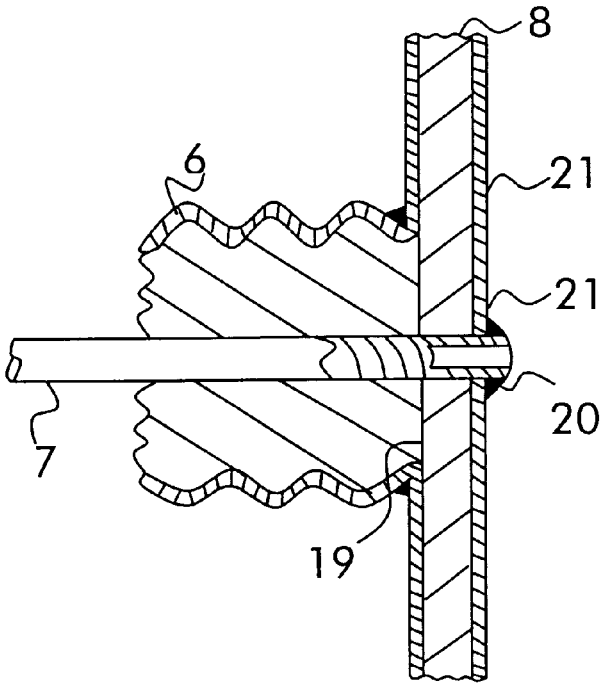
FIG. 2 is an enlarged detailed view showing the manner of connection of a coaxial cable to the dipole feed arrangement of the present invention.

The conductor element 12 also includes a circular area 19 which is free of conductive material. This area is coaxial with a central through-hole 20. The diameter of the circular area 19 is such that it is slightly smaller than the outside diameter of the outer conductor 6 of coaxial feeder cable 5. A rim of the conductive material bounding circular area 19 forms a first connection zone for connecting the conductor element 12, by, for example, soldering, to outer conductor 6 of the coaxial feeder 5, as shown in FIG. 2.

On the opposite side of the planar support 8 shown in FIG. 4, a conductive pattern in the form of a transmission line element 21, is supported on a surface 22 of the planar support. The transmission line element includes the above mentioned through-connections 17 and 18 which electrically connect the transmission line element to respective dipoles 10 and 11. Central through-hole 20, through planar support 8, permits the centre conductor 7 of the coaxial feeder 5 to be connected, by, for example, soldering, to a second connection zone 23, as shown in FIG. 2.

Optimum symmetry of the feed arrangement's radiation pattern requires that substantially identical current amplitudes flow in each half of each dipole. This can be achieved in the present invention by carefully selecting the location of each through-connection 17 and 18, and the location and depth of the notches 15 and 16.

Advantageously, the dipole feed arrangement described above is implemented by using PCB techniques.

The claims defining the invention are as follows:

1. A dipole feed arrangement for a parabolic reflector antenna having an operating frequency, said arrangement comprising a planar member of insulating material supporting on one side thereof a first pattern of conductive material forming at least two spaced parallel dipole elements of predetermined dimensions whose respective intermediate parts are connected by a single conductive element provided with two opposite collinear slots whose electrical lengths are approximately one quarter of a wavelength at said antenna's operating frequency, said slots bifurcating respective dipoles, said conductive element including a first connection zone for connection of a coaxial feeder cable's outer conductor, said slots and said conductive element forming part of an integral balun means, wherein said conductive element further includes at least two spaced notches of predetermined depth and located on one side of said conductive element; and wherein a second pattern of conductive material is supported on the other side of said planar member, forming a transmission line element provided with a second connection zone for connection to an inner conductor of a coaxial feeder cable, said first connection zone and said second connection zone being substantially coaxial, said transmission line element having two spaced through-connection each of which communicates with a predetermined part of one of said dipole elements.

2. A dipole feed arrangement as claimed in claim 1, wherein said first pattern of conductive material, said second pattern of conductive material and said planar member are arranged in the form of a printed circuit board.

3. A parabolic reflector antenna arrangement comprising:

a parabolic reflector element having a focal point;

a dipole feed arrangement having an operating frequency, said arrangement comprising a planar member of insulating material supporting on one side thereof a first pattern of conductive material forming at least two spaced parallel dipole elements of predetermined dimensions whose respective intermediate parts are connected by a single conductive element provided with two opposite collinear slots whose electrical lengths are approximately one quarter of a wavelength at said antenna's operating frequency, said slots bifurcating respective dipoles, said conductive element including a first connection zone for connection of a coaxial feeder cable's outer conductor, said slots and said conductive element forming part of an integral balun means, wherein said conductive element further includes at least two spaced notches of predetermined depth and located on one side of said conductive element; and wherein a second pattern of conductive material is supported on the other side of said planar member, forming a transmission line element provided with a second connection zone for connection to an inner conductor of a coaxial feeder cable, said first connection zone and said second connection zone being substantially coaxial, said transmission line element having two spaced through-connections each of which communicates with a pre-determined part of one of said dipole elements; and wherein said dipole feed arrangement is fixedly located at said parabolic reflector element's focal point; and said parabolic reflector antenna arrangement further comprising a sub-reflector element fixedly located at a predetermined distance from said dipole feed arrangement remote from said parabolic reflector element.

4. A parabolic reflector antenna arrangement as claimed in claim 3, wherein said dipole feed arrangement is fixedly located by a tube fixedly extending from a center of said parabolic reflector element, said dipole feed arrangement being attached to said tube at the focal point of said parabolic reflector element.

5. A parabolic reflector antenna arrangement as claimed in claim 4, further comprising a coaxial feeder cable, including an outer conductor and an inner conductor, located within said tube, said feeder cable extending from a feeder terminal to said first and second connection zones of said dipole feed arrangement, said outer conductor being electrically connected to said first connection zone and said inner conductor being electrically connected to said second connection zone.

6. A parabolic reflector antenna arrangement as claimed in claim 5, wherein said inner and outer conductors are electrically connected to said respective connection zones by soldering.

7. A parabolic reflector antenna as claimed in claim 3, wherein said dipole feed arrangement and said sub-reflector element are enclosed within a radome.

8. A parabolic reflector antenna arrangement as claimed in claim 7, adapted to operate at a frequency of 3.5 GHz.

* * * * *